US005727485A

United States Patent [19]

Morita

[11] Patent Number: 5,727,485

[45] Date of Patent: Mar. 17, 1998

[54] STITCHING DATA PROCESSING DEVICE CAPABLE OF DISPLAYING STITCHING PERIOD OF TIME FOR EACH SEGMENT OF EMBROIDERY

[75] Inventor: Nami Morita, Nagoya, Japan

[73] Assignee: Brother Kogyo Kabushiki Kaisha, Nagoya, Japan

[21] Appl. No.: 735,395

[22] Filed: Oct. 21, 1996

[30] Foreign Application Priority Data

Oct. 20, 1995 [JP] Japan ..... 7-297684

[51] Int. Cl.[6] ..... D05C 5/04; D05B 21/00

[52] U.S. Cl. ..... 112/102.5; 112/445

[58] Field of Search ..... 112/102.5, 103, 112/470.06, 475.19, 454, 445, 456, 458, 470.02

[56] References Cited

U.S. PATENT DOCUMENTS 5,029,540 7/1991 Hisatake et al. ..... 112/102.5
5,228,403 7/1993 Sugimoto ..... 112/102.5
5,347,940 9/1994 Hori et al. ..... 112/445 X
5,474,002 12/1995 Goto et al. ..... 112/103

FOREIGN PATENT DOCUMENTS

A-62-57585 3/1987 Japan .
A-62-57588 3/1987 Japan .

*Primary Examiner*—Peter Nerbun
*Attorney, Agent, or Firm*—Oliff & Berridge, P.L.C.

[57] ABSTRACT

Based on pattern display data stored in a card ROM, a predetermined number of embroidery pattern examples are displayed in a display unit of a sewing machine. Upon selection of a desired embroidery pattern, segmental embroidery patterns are displayed in an order of stitching. The segmental embroidery patterns are the components of the desired embroidery pattern that are extracted on a color thread basis. When computation of a stitching period of time is instructed in this condition, the stitching period of time is computed for each of the segmental embroidery pattern components and the computed stitching period of time is numerically displayed immediately below the corresponding segmental embroidery pattern component.

15 Claims, 10 Drawing Sheets

STITCHING DATA PROCESSING DEVICE CAPABLE OF DISPLAYING STITCHING PERIOD OF TIME FOR EACH SEGMENT OF EMBROIDERY

BACKGROUND OF THE INVENTION

1. Field of the Invention

The present invention relates to a stitching data processing device capable of displaying embroidery patterns. More particularly, the invention relates to a stitching data processing device capable of displaying a stitching period of time for each of segmental embroidery patterns extracted on a color thread basis or for each character or symbol of a character/symbol string embroidery pattern.

2. Description of the Related Art

There has been known a stitching data processing device, such as an electrically controlled sewing machine having a control unit. The control unit is provided with a non-volatile memory storing pattern data for stitching a plurality of different categories of embroidery patterns, such as ornamental embroidery patterns, one point embroidery patterns, character embroidery patterns, and other embroidery patterns. The sewing machine also includes a display unit having a large liquid crystal display. The display unit displays embroidery pattern examples belonging to a selected embroidery category when an operator depresses a category selection key. From the embroidery pattern examples displayed in the display unit, the operator can select a desired embroidery pattern. Recent sewing machines are further capable of displaying a stitching period of time for stitching the selected embroidery pattern.

Japanese Laid-Open Patent Publications Sho-62-57585 and Sho-62-57588 disclose displaying a stitching period of time in a liquid crystal display (LCD) computed based on stitching data stored in a PROM. The stitching period of time is given by a sum of a stitch involving time involved in stitching and a fabric feeding time for feeding a fabric workpiece without stitching. The stitch involving time is computed by multiplying one seam forming period of time to a stitch number derived from the corresponding stitching data. The fabric feeding time is computed by multiplying the fabric feeding number to a time for each fabric feeding. Stitching of the embroidery pattern is commenced upon notifying the operator of the stitching period of time thus computed. The displayed stitching period of time may be determined to include a period of time for attaching and detaching a fabric workpiece.

Embroidery patterns of, for example, an elephant or horse, are stitched with different color threads. For stitching such embroidery patterns, recent sewing machines use embroidery pattern data containing thread change information. The thread change information is annexed to each piece of embroidery data regarding a segmental embroidery pattern extracted on a color thread basis so that change of a color thread can be made each time when stitching of the segmental embroidery pattern is complete.

The aforementioned Japanese Laid-Open Patent Publications Sho-62-57585 and Sho-62-57588 disclose computing an entire stitching period of time of a selected embroidery pattern and displaying the computed period of time prior to stitching the selected embroidery pattern, so it is convenient that an operator can recognize the stitching period of time for the embroidery pattern he or she has selected. However, it is inconvenient in that the time when the sewing machine is stopped for changing a color thread is not known to the operator when the embroidery pattern is stitched using a plurality of different color threads. Therefore, the operator cannot leave from the sewing machine until the entire stitching is over.

SUMMARY OF THE INVENTION

The present invention has been made to eliminate the aforementioned inconvenience of the conventional sewing machines, and accordingly it is an object of the present invention to provide a stitching data processing device that can display a stitching period of time for each of segmental embroidery patterns extracted on a color thread basis or for each character or symbol of a character/symbol string embroidery pattern so that an operator can recognize the time to change the color thread.

To achieve the above and other objects, there is provided a stitching data processing device that includes a display unit, data storage means, pattern display control means, pattern selection means, time computing means, and time display control means. The data storage means stores a plurality of pieces of pattern data. Each of the plurality of pieces of pattern data contains a plurality of pieces of embroidery data relating to a plurality of embroidery patterns. Each of the plurality of embroidery patterns is stitched by at least one color thread. The pattern display control means is provided for displaying a predetermined number of embroidery patterns in the display unit based on a selected one of the plurality of pieces of pattern data. The pattern selection means selects a desired embroidery pattern from the predetermined number of embroidery patterns displayed in the display unit. The desired embroidery pattern is, for example, a one-point embroidery stitched by a plurality of different color threads. In such a case, the time computing means computes a stitching period of time for each of segmental embroidery patterns extracted from the desired embroidery pattern on a color thread basis. The time computing means outputs time data representative of a computed stitching period of time. The time display control means displays in the display unit the stitching period of time for each of segmental embroidery patterns based on the time data wherein the stitching period of time is displayed in association with a corresponding segmental embroidery pattern displayed in the display unit. The segmental embroidery patterns are displayed sequentially in an order of stitching of the desired embroidery pattern.

In accordance with another aspect of the present invention, there is provided a stitching data processing device that includes a display unit, data storage means, pattern display control means, pattern selection means, time computing means, and time display control means substantially as described above. The pattern selection means may select a plurality of embroidery patterns, such as a character string, from the predetermined number of embroidery patterns displayed in the display unit. In this case, the time computing means computes a stitching period of time for each of the plurality of embroidery patterns selected by the pattern selection means, that is, each character consisting of the character string. The time computing means outputs time data representative of a computed stitching period of time. The time display control means displays in the display unit the stitching period of time for each of the plurality of embroidery patterns based on the time data, and the time display control means displays the stitching period of time in association with a corresponding embroidery pattern displayed in the display unit. Upon displaying the stitching period of time for each of the embroidery patterns selected, execution means executes stitching of the plurality of embroidery patterns selected by the pattern selection means.

The plurality of embroidery patterns selected by the pattern selection means are displayed in the display unit in an order of selection of the plurality of embroidery patterns.

BRIEF DESCRIPTION OF THE DRAWINGS

The particular features and advantages of the invention as well as other objects will become more apparent from the following description taken in connection with the accompanying drawings, in which.

DETAILED DESCRIPTION OF TIME PREFERRED EMBODIMENTS

A preferred embodiment of the present invention will be described with reference to the accompanying drawings. The embodiment is concerned with a stitching data processing device provided in an electrically controlled zigzag sewing machine to which an embroidery device is detachably mounted.

Figure 1:
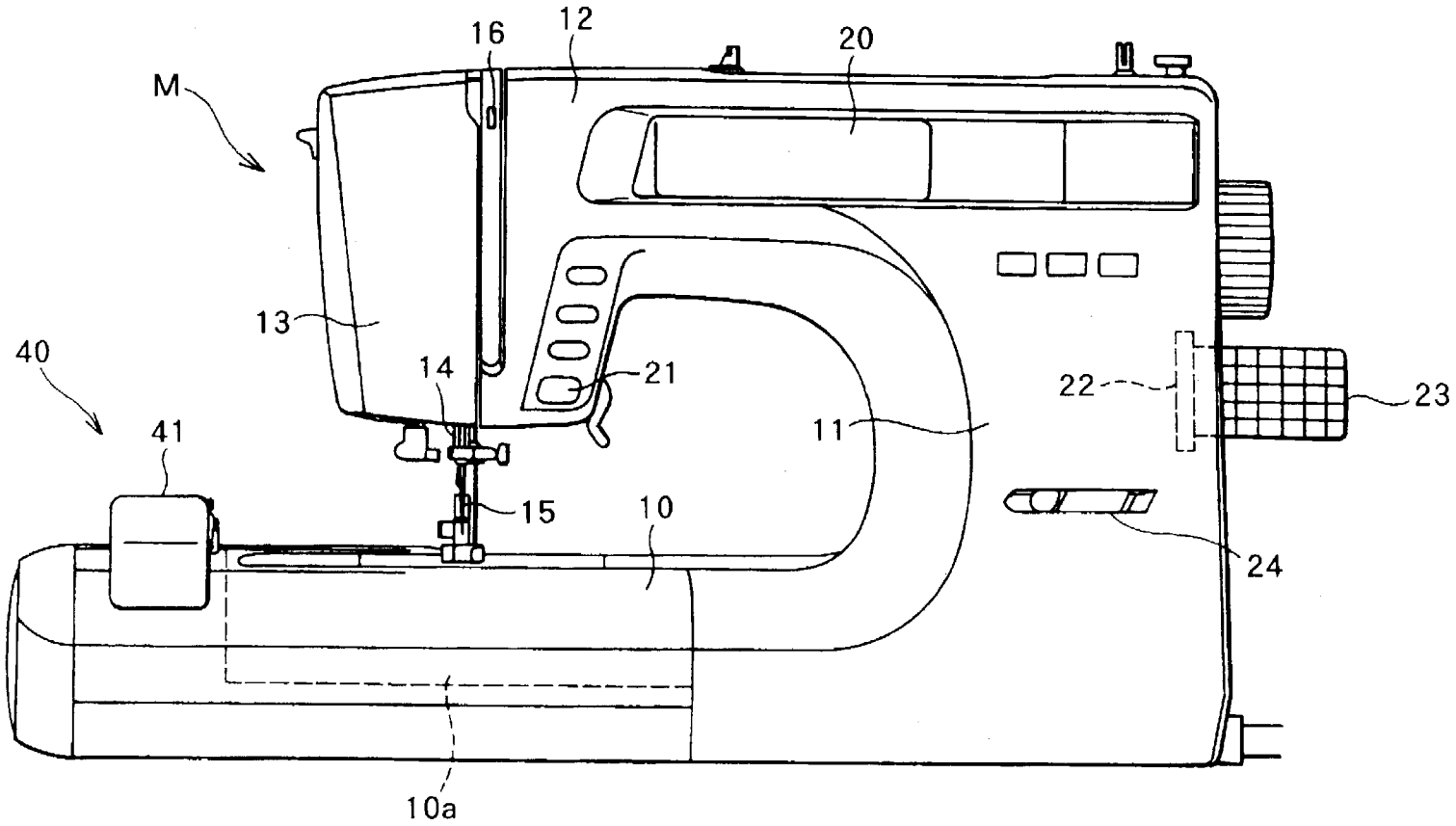
FIG. 1 a front view showing an electrically controlled sewing machine provided with an embroidery device according to an embodiment of the present invention.

The zigzag sewing machine M includes a bed portion 10; a column portion 11 provided with an upright posture at the right tip portion of the bed portion 10 as viewed in FIG. 1; and an arm portion 12 extending from the column portion 11 leftward as viewed in FIG. 1 in parallel with the bed portion 10. Although not shown in the drawings, a feed dog vertical movement mechanism for vertically driving a feed dog and feed dog horizontal movement mechanism for horizontally driving the feed dog are provided to the bed portion 10.

Figure 2:
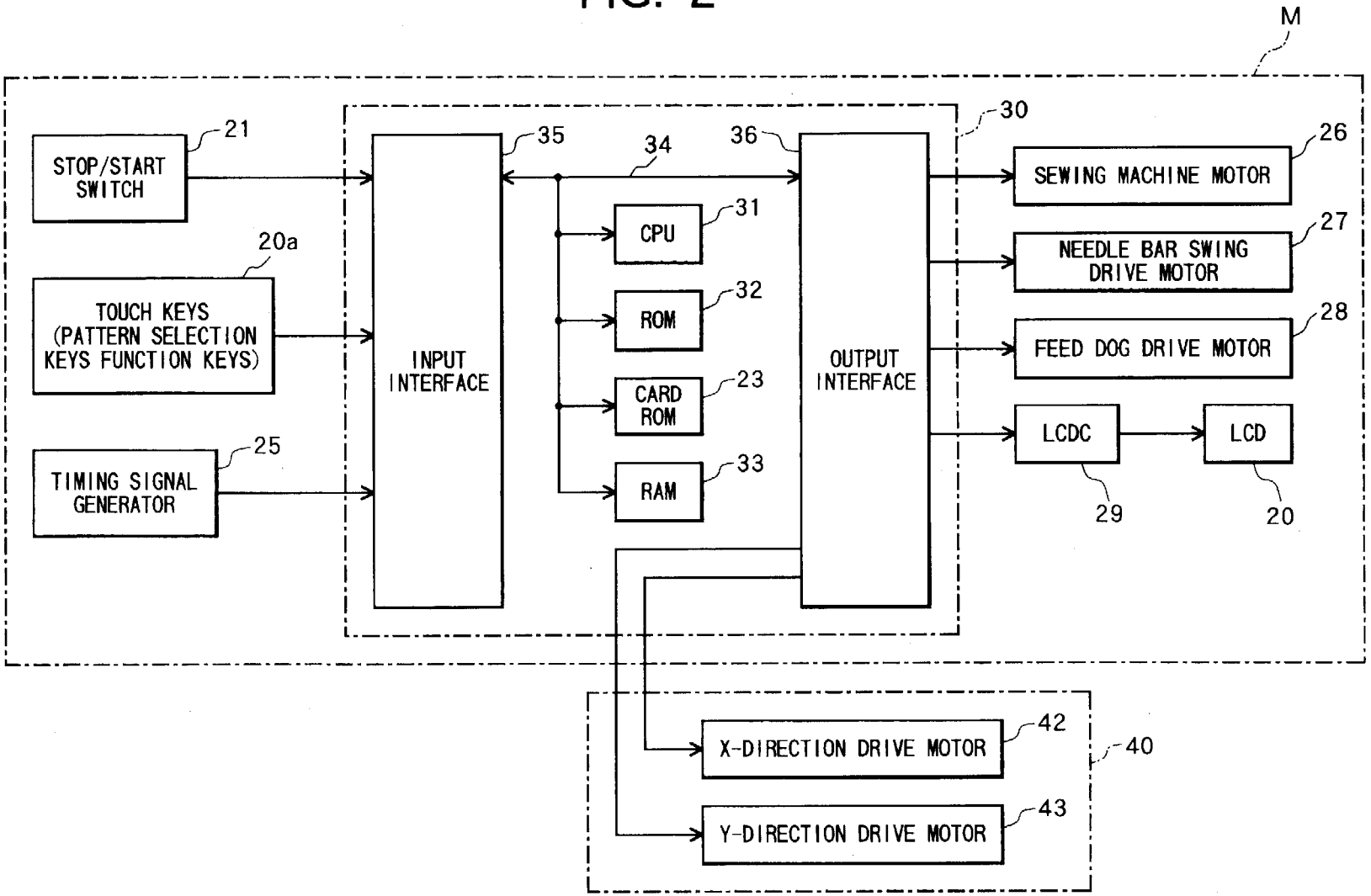
FIG. 2 is a block diagram showing a control system for the sewing machine and the embroidery device.

Although not shown in the drawings, the arm portion 12 is provided with a needle bar drive mechanism for vertically driving a needle bar 14 with a needle 15 mounted to its lower tip; a needle bar swinging mechanism for swinging the needle bar 14 in a direction perpendicular to the direction in which a workpiece cloth is fed; and a thread take up lever mechanism (not shown) for vertically driving a take up thread lever 16 in timed relation to vertical drive of the needle bar 14. As shown in FIG. 2, a sewing machine motor 26 is provided for driving the needle bar drive mechanism, the thread take up lever drive movement mechanism, and the feed dog vertical movement mechanism; a needle bar swing drive motor 27 is provided for driving the needle bar swing mechanism; and a feed dog drive motor 28 is provided for driving the feed dog horizontal movement mechanism.

A liquid crystal display unit 20 capable of displaying a plurality of embroidery patterns and a variety of messages is provided to the front surface of the arm portion 12. A plurality of touch keys 20*a* formed from transparent electrodes are provided to the display regions of display unit 20. The touch keys 20*a* serve as pattern selection keys for selecting patterns from embroidery patterns displayed on the display unit 20 and also as function keys displayed with function names. A start/stop switch 21 for commanding start and stop of sewing operations is provided in the vicinity of a head portion 13 of the arm portion 12. The column portion 11 is provided with a memory card mounting connector 22 for detachably mounting card ROMs 23, which serve as an external memory; and a speed changing knob 24 for adjusting sewing speed.

A free arm portion 10*a* is formed to the left tip of the bed portion 10. An embroidery device 40 capable of sewing large embroidery patterns is detachably mounted to the free arm portion 10*a*. An embroidery table 41 is provided to the embroidery device 40 so as to be movable in both a Y-direction in parallel to a workpiece cloth feeding direction and an X-direction perpendicular to the Y-direction. Although not shown in the drawings, a fabric holding frame for supporting the workpiece cloth can be detachably mounted to the embroidery table 41. An X-direction drive motor 42 for driving the embroidery table 41 in the X-direction and a Y-direction drive motor 43 for driving the embroidery table 41 in the Y-direction are provided within the embroidery device 40.

Next, a control system of the sewing machine 1 and the embroidery device 40 will be described while referring to the block diagram shown in FIG. 2.

The control device 30 of the sewing machine M includes a microcomputer, an input interface 35, and an output interface 36. The microcomputer includes a CPU 31, a ROM 32, a card ROM 23, and a RAM 33. The input interface 35 and the output interface 36 are connected to the microcomputer via a bus 34, such as a data bus. Signals from the start/stop switch 21, the touch keys 20*a*, and a timing signal generator 25 are supplied to the microcomputer through the input interface 35. Drive signals and drive pulse signals for driving the sewing machine motor 26, the needle bar swing drive motor 27, the feed dog drive motor 28, and a liquid crystal display controller (LCDC) 29, which is for supplying display signals to the display unit 20, are supplied from the microcomputer through the output interface 36. The timing signal generator 25 is provided for detecting a rotational phase of an upper shaft of the sewing machine M.

The output interface 36 is connected to the X-direction drive motor 42 and the Y-direction drive motor 43 of the embroidery device 40. The drive motors 42, 43 are independently driven based on separate drive signals output from the control unit 30 to move the embroidery table 41 to a particular position for each attach using a combination of movements in the X- and Y-directions, thereby enabling sewing of a variety of embroidery patterns in the workpiece cloth supported in the cloth support frame. A stitching data processing device is constructed with the control unit 30, the display unit 20, and touch keys 20*a*.

Figure 3:
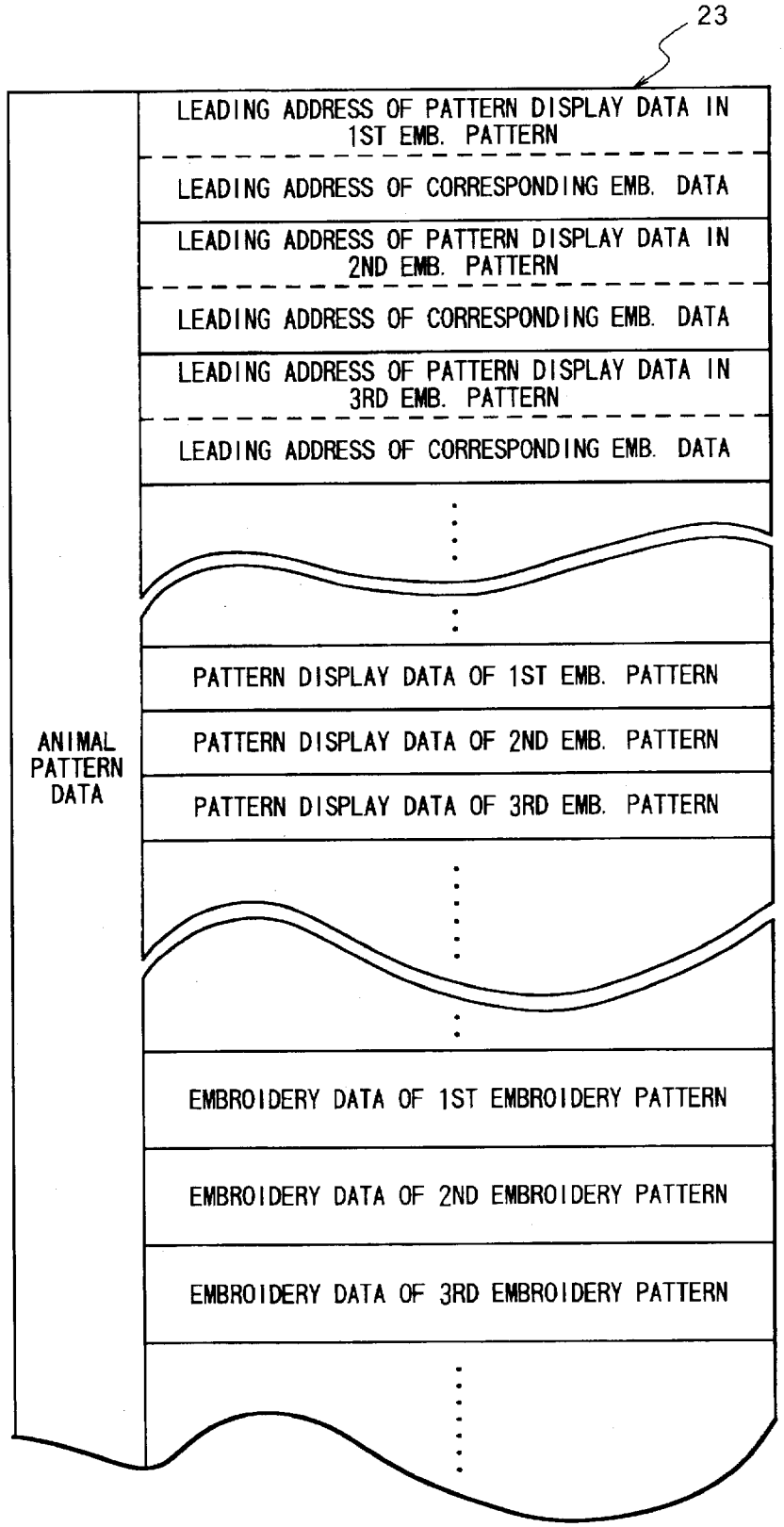
FIG. 3 is an explanatory diagram illustrating a structure of pattern data stored in a card ROM.
Figure 4:
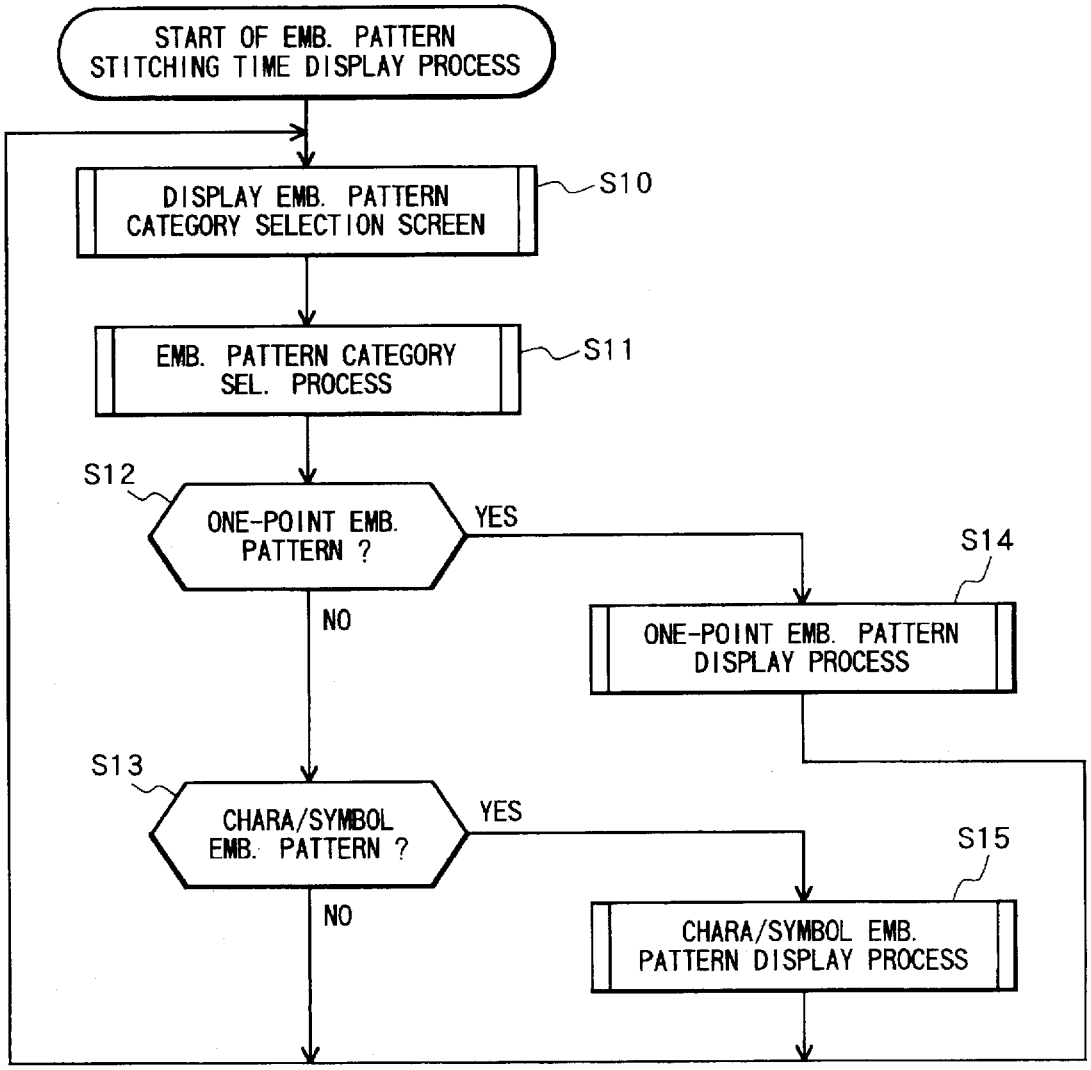
FIG. 4 is a flowchart illustrating an embroidery pattern display control routine according to the embodiment of the present invention.

The card ROM 23 has stored therein pattern data including embroidery data for sewing, and pattern display data for displaying a variety of embroidery patterns that are classified into several groups, such as "animal" embroidery patterns including an elephant pattern and a horse pattern, "people" embroidery patterns, and "character/symbol" embroidery patterns including alphanumerals, and symbol marks. For example, as shown in FIG. 3, the pattern data regarding the "animal" embroidery patterns includes a leading address of pattern display data in a first embroidery pattern (panda), and a leading address of the first embroidery data, a leading address of pattern display data in a second embroidery pattern (elephant), and a leading address of the second embroidery data, a leading address of pattern display data in a third embroidery pattern (horse), and a leading address of the third embroidery data, and so on.

The pattern data of the first, second, third embroidery patterns and so on are sequentially stored in the card ROM 23, and the embroidery data corresponding to the first, second, third embroidery patterns and so on are also sequentially stored therein. The pattern display data and the embroidery data for the various embroidery patterns falling in the categories of "people" and "character/symbols" are also stored in the card ROM 23 on the category basis. The pattern display data and the embroidery data relating to the embroidery pattern constitute pattern data.

The embroidery data is representative of needle locations and is given by values on absolute or relative coordinates corresponding to a fabric supporting frame. Based on the embroidery data, the workpiece fabric is moved relative to a needle 14 by the embroidery device 40. The embroidery data may represent all of the needle positions or apex positions of blocks, such as triangle, rectangle, into which the embroidery pattern is divided.

The embroidery pattern can be divided into a plurality of segmental patterns on a color basis so that the embroidery pattern may be stitched using different color threads. The pattern display data is constructed with plural pieces of segmental pattern display data. Thread change information is annexed to the trailing portion of each segmental pattern display data for instructing the operator to stop stitching the embroidery for replacement of the thread.

The ROM 32 has stored therein control programs including an embroidery pattern display control program to be described later and a stitch control program. The stitch control program is for controlling the drive motors 27 and 28 based on embroidery data for performing zigzag stitches or triple stitches, or for controlling the drive motors 42 and 43 for performing embroidery stitches based on embroidery data. The RAM 33 is provided with buffers and counters which are necessary for executing the embroidery pattern display control and the stitch control.

An embroidery pattern display process to be executed by the control device 30 of the sewing machine M will be described while referring to the flowcharts shown in FIGS. 4 through 7 wherein Si (I=10, 11, 12 . . . ) indicates individual step numbers of the routine.

Figure 8:
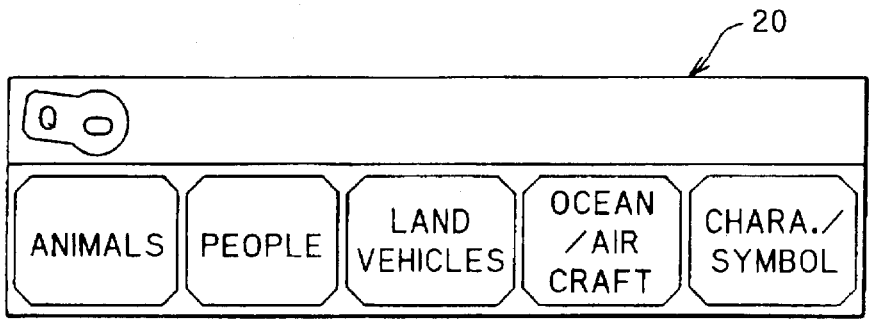
FIG. 8 is an explanatory diagram showing category names of stitchable embroidery patterns displayed in a display unit.

The routine starts when the sewing machine M is powered. First, a category selection screen is displayed in the display unit 20 for selection of a desired category of embroidery patterns (S10). For example, as shown in FIG. 8, the display unit 20 displays such categories as "Animals", "People", "Land Vehicles", "Ocean/Air Craft", and "Character/Symbol". A desired category can be selected upon depressing the touch key 20*a* provided in an overlapping relation to the corresponding category, whereupon an embroidery pattern category selection process is executed (S11). When the selected category pertains to a one-point embroidery pattern (S12: Yes), then a one-point embroidery pattern display process (see FIG. 5) is executed (S14).

Figure 9:
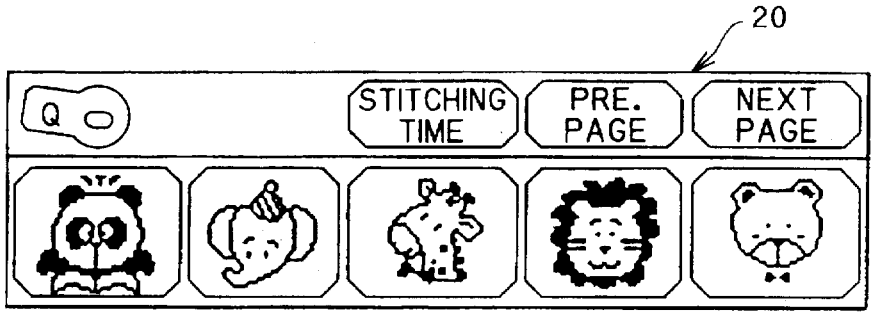
FIG. 9 is an explanatory diagram showing a set of animal embroidery patterns displayed in the display unit according to the embodiment of the present invention.

Upon start of this process, a first set of embroidery patterns belonging to the selected category is displayed in the display unit 20 (S20). When, for example, the category of "Animals" is selected, the first five animal embroidery patterns corresponding to the first to fifth embroidery patterns stored in the card ROM 23 are displayed as shown in FIG. 9. In this example, the first embroidery pattern shows a panda, the second embroidery pattern an elephant, the third embroidery pattern a giraffe, the fourth embroidery pattern a lion, and the fifth embroidery pattern a bear.

When the touch key 20*a* corresponding to "Next Page" is depressed (S21, S22: Yes), the next five animal embroidery patterns are displayed (S26), whereupon the routine returns to S21. When the tough key 20*a* corresponding to "Previous Page" is depressed (S21: Yes, S22: No, S23: Yes), the previous five animal embroidery patterns are displayed (S27), whereupon the routine returns to S21.

When the touch key 20*a* corresponding to the "Stitching Time" is depressed to display a stitching time (S21: Yes, S22, S23: No, S24: Yes), computation of stitching time is performed with respect to all the embroidery patterns currently displayed in the display unit 20 (S28).

Figure 10:
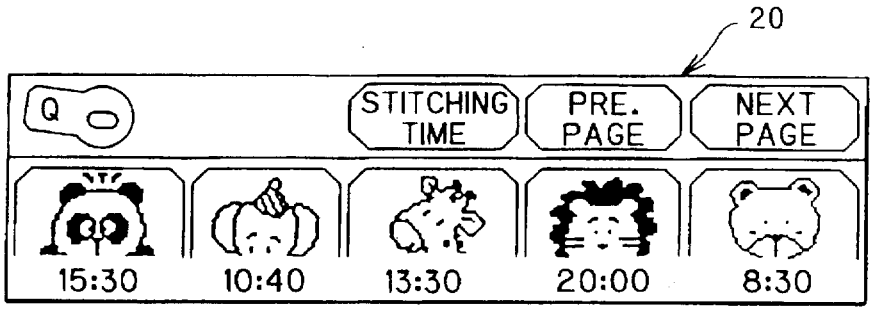
FIG. 10 is an explanatory diagram showing a stitching period of time displayed for each of the animal embroidery patterns according to the embodiment of the present invention.

In this stitching time computing process, the stitching time for each of the embroidery patterns is computed based on the corresponding embroidery data and a stitching speed set for the embroidery pattern. Specifically, the stitching time is given by multiplying the number of stitches to a cycle time for one stitch. The stitching times computed for all the embroidery patterns are displayed in positions corresponding to the embroidery patterns (S29), whereupon the routine returns to S21. When the embroidery patterns of panda, elephant, giraffe, lion, and bear are displayed in the display unit 20 as shown in FIG. 9, the computed stitching times are displayed in minutes:seconds format immediately below the positions where those animal embroidery patterns are displayed as shown in FIG. 10.

Figure 6:
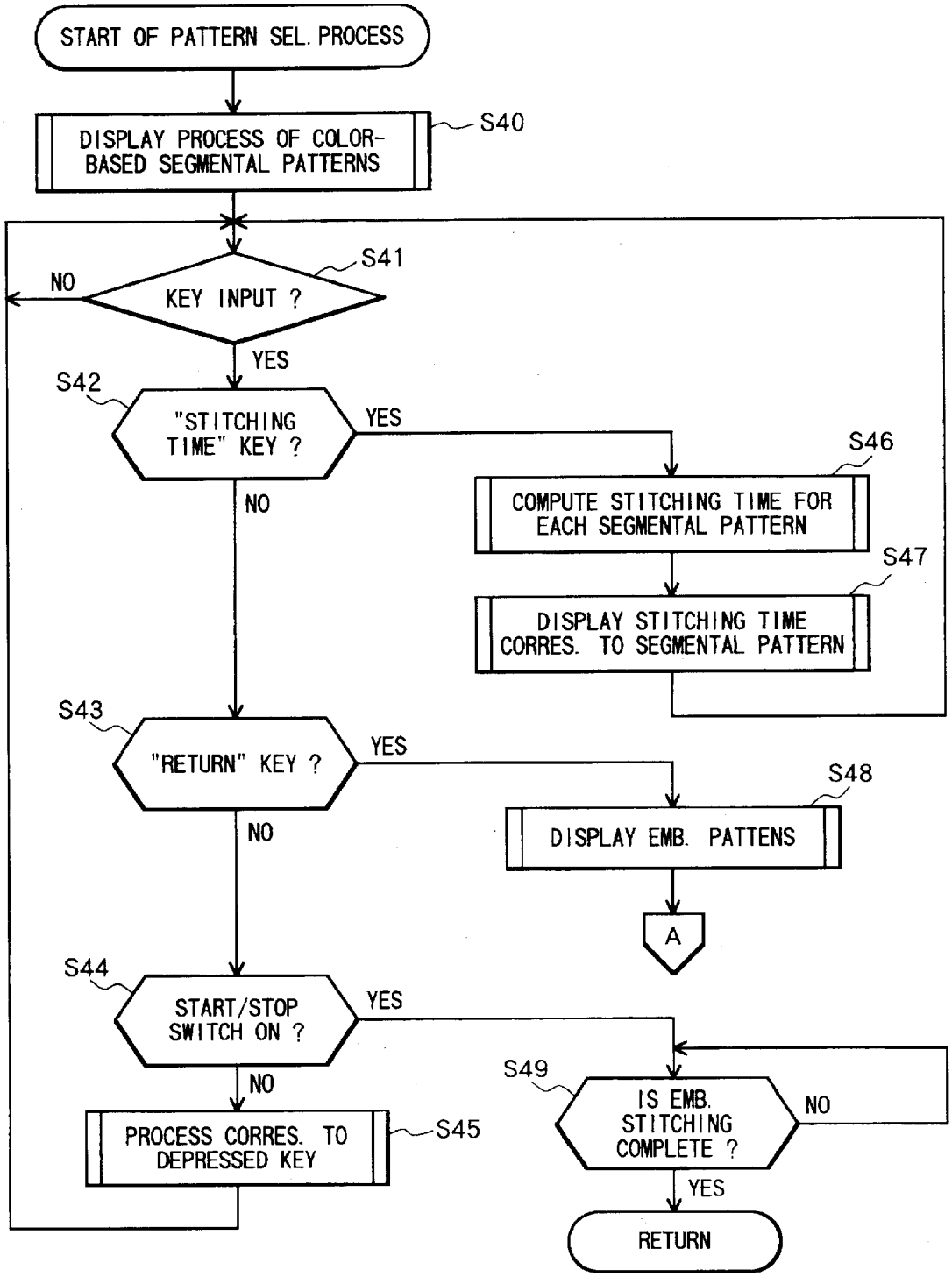
FIG. 6 is a flowchart illustrating a pattern selection control routine according to the embodiment of the present invention.
Figure 11:
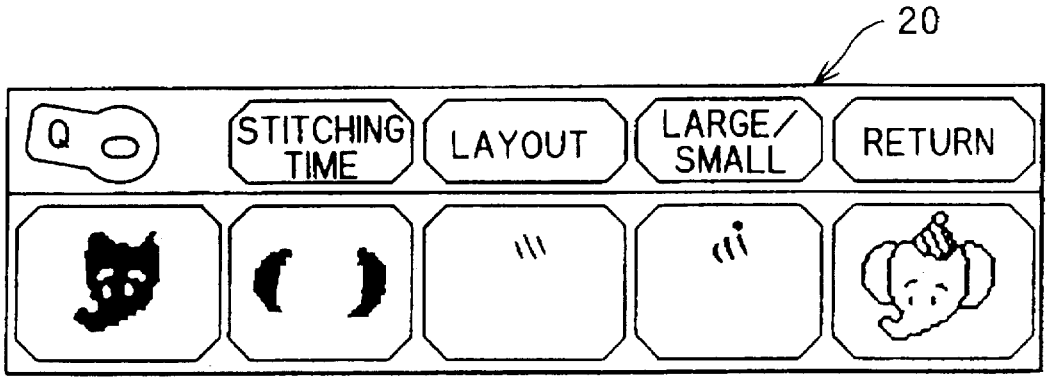
FIG. 11 is an explanatory diagram showing a display of color-based segmental pattern components making up of an elephant embroidery.

When the touch key 20*a* corresponding to the desired embroidery pattern is depressed (S21: Yes, S22, S23, S24: No, S25: Yes), a pattern selection process as illustrated in the flowchart of FIG. 6 is executed (S30). In this case, the depressed touch key 20*a* serves as a pattern selection key. When this process starts, pattern display data for the embroidery pattern as specified by the touch key 20*a* is read from the card ROM 23, and a plurality of color-based segmental patterns are sequentially displayed in an order to be stitched (S40). For example, when the embroidery pattern of elephant is selected, five pattern components making up the embroidery pattern of the elephant are sequentially displayed as shown in FIG. 11.

Figure 12:
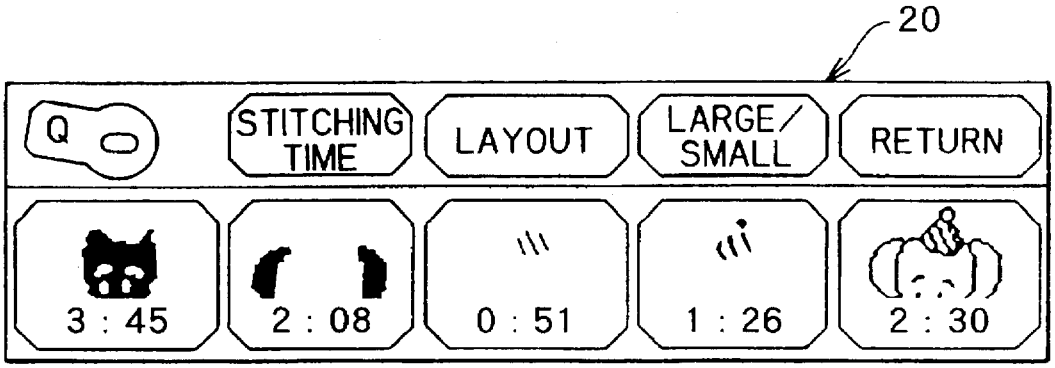
FIG. 12 is an explanatory diagram showing a stitching period of time for each of the color-based segmental pattern components.

When the stitching rime key is depressed to display the stitching time for the specified embroidery pattern (S41, S42: Yes), the stitching period time for each of the segmental patterns is computed based on the embroidery data of the specified embroidery pattern and the stitching speed thereof similar to the processes in S28 and S29 (S46). The computed stitching time is displayed in the display unit 20 (S47), whereupon the routine returns to S41. For example, as shown in FIG. 12, the stitching periods of time 3:45, 2:08 and on for the segmental embroidery patterns of elephant are displayed in the display unit 20.

When the return key is depressed (S41: Yes, S42: No, S43: Yes), the embroidery patterns belonging to the currently selected embroidery pattern group are displayed in the display unit 20 (S48), whereupon the routine returns to S21 of the embroidery pattern display process. In this condition, the operator can again select a desired embroidery pattern for the subsequent stitching. On the other hand, when the keys other than the stitching time key, return key and start/stop key 21 are depressed in the pattern selection process (S41: Yes, S42, S43, S44: No), the process corresponding to the depressed key is executed (S45), whereupon the routine returns to S41. When the start/stop key 21 is depressed (S41: Yes, S42, S43: No, S44: Yes), an embroidery stitching control (not shown) is executed. When the embroidery stitching control ends (S49: Yes), the routine returns to S10 of the embroidery pattern display process.

Figure 5:
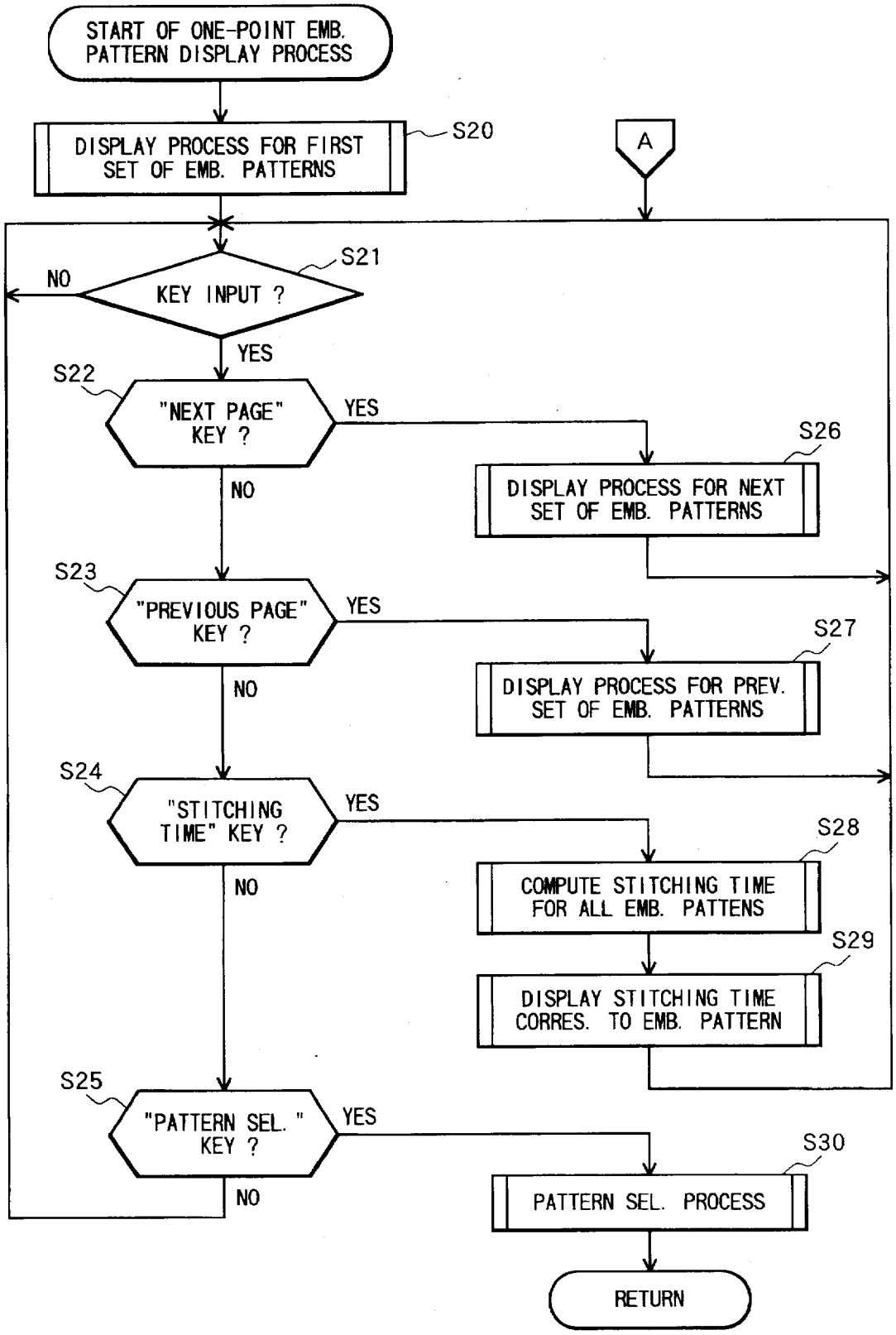
FIG. 5 is a flowchart illustrating a one-point embroidery pattern display control routine according to the embodiment of the present invention.
Figure 7:
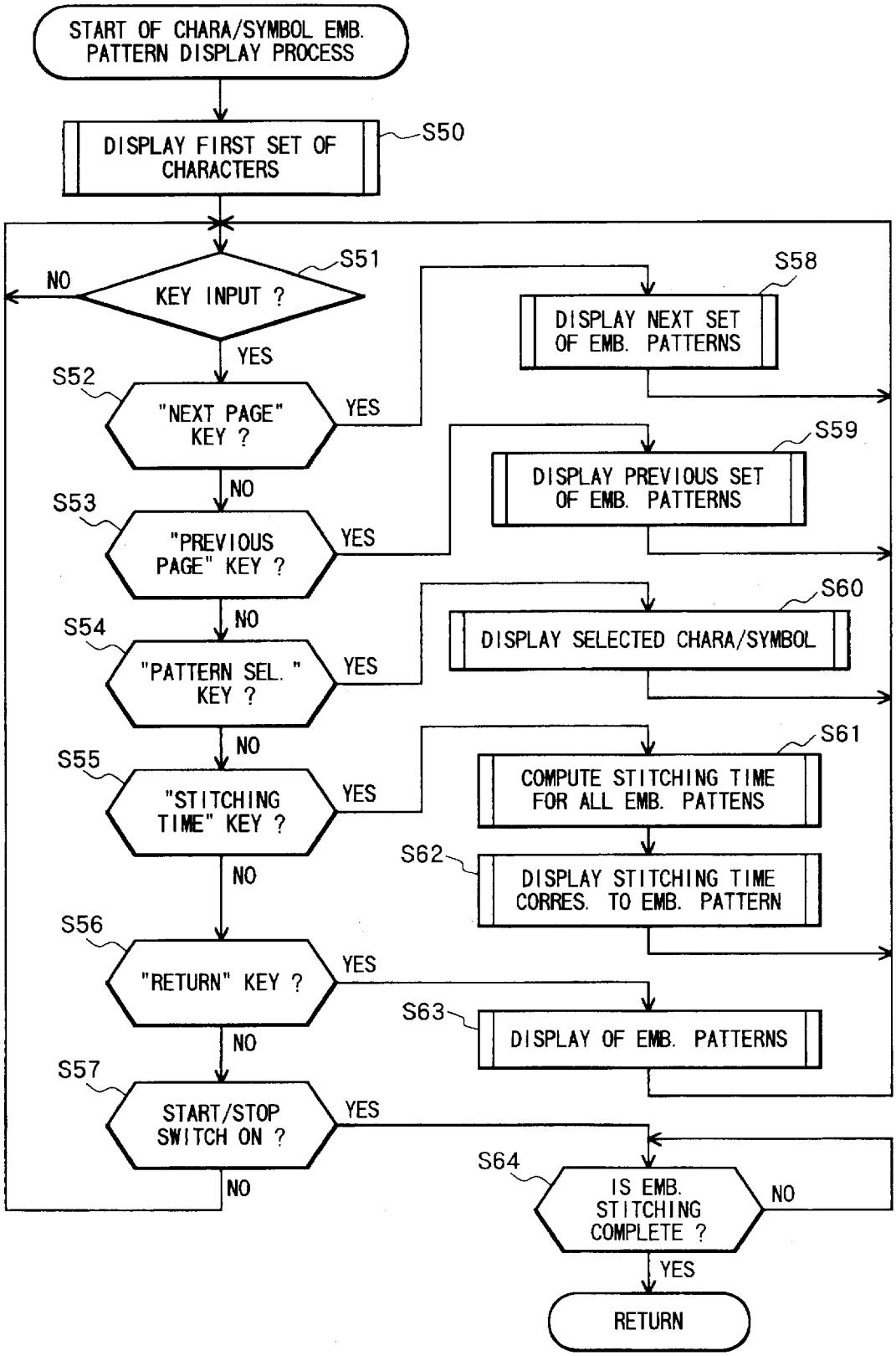
FIG. 7 is a flowchart illustrating a character/symbol embroidery pattern display control routine according to the embodiment of the present invention.

In the embroidery pattern display process shown in the flowchart of FIG. 5, when a character/symbol embroidery pattern is selected (S12: No, S13: Yes), a character/symbol embroidery pattern display process shown in the flowchart of FIG. 7 is executed (S15).

Figure 13:
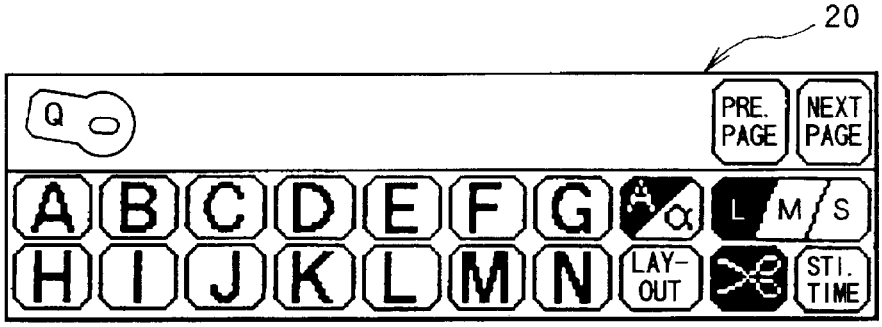
FIG. 13 is an explanatory diagram showing a set of character/symbol embroidery patterns displayed in the display unit according to the embodiment of the present invention.

When this process is started, a first set of character and symbol embroidery patterns belonging to the character/symbol category is displayed in the display unit 20 (S50). For example, as shown in FIG. 13, the first embroidery character "A" to the fourteenth embroidery character "N" that are stored in the card ROM 23 are displayed in the display unit 20.

Figure 14:
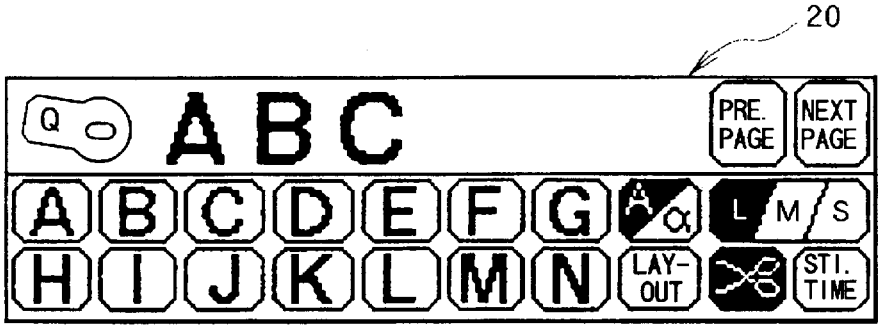
FIG. 14 is an explanatory diagram showing a set of character/symbol embroidery patterns and a selected character string "ABC" displayed in the display unit according to the embodiment of the present invention.

When the "Next Page" key is depressed (S51, S52: Yes), the next set of character and symbol embroidery patterns are displayed (S58). When the "Previous Page" key is depressed (S51: Yes, S52: No, S53: Yes), the previous set of character and symbol embroidery patterns are displayed (S59). When pattern selection keys are depressed, that is, when the touch keys 20*a* corresponding to the desired characters or symbols among those displayed in the display unit 20 are depressed (S51: Yes, S52, S53: No, S54: Yes), the characters or the symbols that have been selected are displayed in the character display region of the display unit 20 (S60), whereupon the routine returns to S51. For example, when three letters "A", "B" and "C" are selected, a character string of "ABC" is displayed in the upper column of the display unit 20 as shown in FIG. 14.

Figure 15:
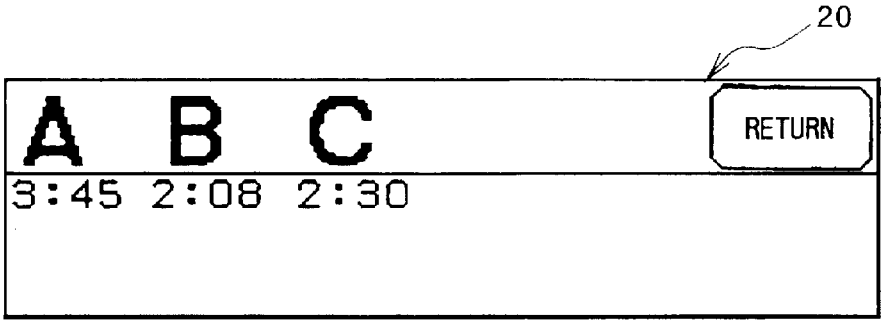
FIG. 15 is an explanatory diagram showing a stitching period of time displayed for each of the characters.

When the "Stitching Time" key is depressed in this condition (S51: Yes, S52, S53, S54: No, S55: Yes), the stitching period of time for each of the characters making up of the selected character string is computed (S61) and the computed period of time is displayed in positions corresponding to the character (S62), whereupon the routine returns to S51. For example, when the character string of "ABC" is selected and displayed, the stitching period of time for each of the letters "A", "B" and "C" is displayed immediately below these letters as shown in FIG. 15. When the "Return" key is depressed in this condition (S56: Yes), S63 is executed, and when the "Start/Stop" key is depressed (S57: Yes), S64 is executed, whereupon the routine returns to S10 of the embroidery pattern display process.

While only one exemplary embodiment of this invention has been described in detail, those skilled in the art will recognize that there are many possible modifications and variations which may be made in this exemplary embodiment while yet retaining many of the novel features and advantages of the invention. For example, a buzzer or an alarm may be provided for alerting an operator of the end of stitching of each segmental embroidery pattern. The buzzer may be actuated immediately before the end of stitching of the segmental embroidery pattern. By doing so, the operator can return to the sewing machine at a relevant timing for exchanging the color thread. In lieu of the buzzer, a pocket bell or a portable telephone may be used for this purpose.

A modification may be made so that the card ROM 23 stores only the pattern display data regarding a plurality of preselected embroidery patterns and the embroidery data is obtained by developing the pattern display data. Conversely, the card ROM 23 may store only the embroidery data and the pattern display data may be obtained by developing the embroidery data. The card ROM 23 may store pattern data that can be developed into the embroidery data and the pattern display data. In the latter case, the pattern data are developed into the pattern display data and the embroidery data.

It is also possible to determine whether stitching period of time is to be computed or not for pattern data that is automatically read from an external memory, such as card ROM. The computation of the stitching period of time can be canceled before completion of the computation.

Further, the present invention is applicable not only to an electrically controlled sewing machines but also to various types of sewing machines with no provision of a stitching mechanism, including a sewing machine that stitches an embroidery while moving a needle relative to an embroidery frame, and a sewing machine that stitches an embroidery while moving a fabric of workpiece back and forth and also left and right directions with a feed dog.

What is claimed is:

1. A stitching data processing device comprising:

a display unit;

data storage means for storing a plurality of pieces of pattern data, each of said plurality of pieces of pattern data containing a plurality of pieces of embroidery data relating to a plurality of embroidery patterns, each of said plurality of embroidery patterns being stitched by at least one color thread;

pattern display control means for displaying a predetermined number of embroidery patterns in said display unit based on a selected one of said plurality of pieces of pattern data;

pattern selection means for selecting a desired embroidery pattern from said predetermined number of embroidery patterns displayed in said display unit;

time computing means for computing a stitching period of time for each of segmental embroidery patterns extracted from the desired embroidery pattern on a color thread basis, and for outputting time data representative of a computed stitching period of time; and time display control means for displaying in said display unit the stitching period of time for each of segmental embroidery patterns based on the time data, said time display control means displaying the stitching period of time in association with a corresponding segmental embroidery pattern displayed in said display unit.

2. The stitching data processing device according to claim 1, wherein said segmental embroidery patterns are displayed sequentially in an order of stitching of said desired embroidery pattern.

3. The stitching data processing device according to claim 2, further comprising execution means for executing a stitching of the desired embroidery pattern, said execution means being operated by an operator.

4. The stitching data processing device according to claim 1, further comprising category display control means for displaying in said display unit a plurality of categories corresponding to said plurality of pieces of pattern data, respectively, and category selection means for selecting a category from said plurality of categories, wherein said pattern display control means displays the predetermined number of embroidery patterns in said display unit based on one of said plurality of pieces of pattern data corresponding to the selected category.

5. The stitching data processing device according to claim 4, wherein said category selection means comprises a plurality of touch switches provided corresponding to said plurality of categories displayed in said display unit.

6. The stitching data processing device according to claim 5, wherein each of said plurality of touch switches comprises a transparent electrode disposed in an overlapping relation to the corresponding category displayed in said display unit.

7. The stitching data processing device according to claim 6, wherein said data storage means stores pattern display data, embroidery pattern data, and a leading address of the embroidery pattern data with respect to each of said plurality of embroidery patterns.

8. The stitching data processing device according to claim 7, wherein said pattern display control means comprises means for sequentially displaying said predetermined number of embroidery patterns in said display unit based on the pattern display data and the leading addresses of said plurality of embroidery patterns.

9. A stitching data processing device comprising:

a display unit;

data storage means for storing a plurality of pieces of pattern data, each of said plurality of pieces of pattern data containing a plurality of pieces of embroidery data relating to a plurality of embroidery patterns, each of said plurality of embroidery patterns being stitched by one color thread;

pattern display control means for displaying a predetermined number of embroidery patterns in said display unit based on a selected one of said plurality of pieces of pattern data;

pattern selection means for selecting a plurality of embroidery patterns from said predetermined number of embroidery patters displayed in said display unit;

time computing means for computing a stitching period of time for each of said plurality of embroidery patterns selected by said pattern selection means, and for outputting time data representative of a computed stitching period of time;

time display control means for displaying in said display unit the stitching period of time for each of said plurality of embroidery patterns based on the time data, said time display control means displaying the stitching period of time in association with a corresponding embroidery pattern displayed in said display unit; and execution means for executing a stitching of said plurality of embroidery patterns selected by said pattern selection means.

10. The stitching data processing device according to claim 9, wherein said plurality of embroidery patterns selected by said pattern selection means are displayed in said display unit in an order of selection of said plurality of embroidery patterns.

11. The stitching data processing device according to claim 9, further comprising category display control means for displaying in said display unit a plurality of categories corresponding to said plurality of pieces of pattern data, respectively, and category selection means for selecting a category from said plurality of categories, wherein said pattern display control means displays the predetermined number of embroidery patterns in said display unit based on one of said plurality of pieces of pattern data corresponding to the selected category.

12. The stitching data processing device according to claim 11, wherein said category selection means comprises a plurality of touch switches provided corresponding to said plurality of categories displayed in said display unit.

13. The stitching data processing device according to claim 12, wherein each of said plurality of touch switches comprises a transparent electrode disposed in an overlapping relation to the corresponding category displayed in said display unit.

14. The stitching data processing device according to claim 13, wherein said data storage means stores pattern display data, embroidery pattern data, and a leading address of the embroidery pattern data with respect to each of said plurality of embroidery patterns.

15. The stitching data processing device according to claim 14, wherein said pattern display control means comprises means for sequentially displaying said predetermined number of embroidery patterns in said display unit based on the pattern display data and the leading addresses of said plurality of embroidery patterns.

* * * * *